US005535641A

United States Patent [19]

Uchida et al.

[11] Patent Number: 5,535,641

[45] Date of Patent: Jul. 16, 1996

[54] ROCKER ARM FORMED BY PRESSING

[75] Inventors: Kazuo Uchida, Yamatotakada; Nobutsuna Motohashi, Gose, both of Japan

[73] Assignee: Koyo Seiko Co., Ltd., Osaka, Japan

[21] Appl. No.: 350,112

[22] Filed: Nov. 29, 1994

[30] Foreign Application Priority Data

Nov. 29, 1993 [JP] Japan ..... 5-298029

[51] Int. Cl.[6] ..... G05G 1/00

[52] U.S. Cl. ..... 74/559; 74/519; 123/90.33; 123/90.41

[58] Field of Search ..... 74/519, 559; 123/90.39, 123/90.40, 90.41

[56] References Cited

U.S. PATENT DOCUMENTS

| | | | |
|---|---|---|---|
| 3,096,749 | 7/1963 | Davidson | 74/559 |
| 4,825,717 | 5/1989 | Mills | 123/90.39 |
| 4,829,647 | 5/1989 | Anderson et al. | 123/90.39 |
| 4,940,048 | 7/1990 | Mills | 123/90.39 |
| 5,010,857 | 4/1991 | Hempelmann et al. | 123/90.41 |
| 5,016,582 | 5/1991 | Mills | 123/90.39 |
| 5,048,475 | 9/1991 | Mills | 74/559 X |
| 5,060,606 | 10/1991 | Hubbard | 74/559 X |
| 5,190,000 | 3/1993 | Van Schaik et al. | 74/519 X |
| 5,207,191 | 5/1993 | Pryba et al. | 123/90.39 |
| 5,251,585 | 10/1993 | Graber | 74/559 X |
| 5,372,097 | 12/1994 | Joseph et al. | 123/90.39 X |

FOREIGN PATENT DOCUMENTS

| | | | |
|---|---|---|---|
| 0573674A1 | 12/1993 | European Pat. Off. | 123/90.39 |

*Primary Examiner*—Vinh T. Luong

*Attorney, Agent, or Firm*—Popham, Haik, Schnobrich & Kaufman, Ltd.

[57] ABSTRACT

A rocker arm formed by pressing includes: a rocker arm body substantially U-shaped in section which is made of a plate material; and a roller rotatably supported between the side walls of the rocker arm body substantially at the middle, the rocker arm body having a semi-spherical pivot engaging portion at one end, and a valve engaging portion at the other end. In the rocker arm, each of the side walls has a pivot-side portion beside said pivot engaging portion which is smaller in wall thickness than the remaining.

4 Claims, 2 Drawing Sheets

ROCKER ARM FORMED BY PRESSING

BACKGROUND OF THE INVENTION

1. Field of the Invention

This invention relates to a rocker arm formed by pressing which is provided in the valve opening and closing mechanism of an engine.

2. Discussion of the Related Art

In an engine, a rocker arm operates as follows: As the cam is rotated in association with the crank shaft, the rocker arm is swung about its one end portion on the pivot side, while causing its other end portion to push the valve stem. In an example of the rocker arm, its body is formed by pressing.

An example of the rocker arm formed by pressing is as shown in FIGS. 4 and 5. In FIGS. 4 and 5, reference character C designates a cam; V, a valve; and P, a lash adjuster's pivot. The rocker arm comprises a rocker arm body 1', and a roller 2' brought into contact with the cam C.

The rocker arm body 1' is so formed by pressing a metal plate that it is U-shaped in section having side walls 3' and 3' on its both sides, and a bottom between those side walls. The bottom has a rectangular through-hole 4' substantially at the middle as viewed longitudinally thereof. The roller 2' is located in the through-hole 4', and rotatably supported on the side walls 3' and 3' through a pin 5'. More specifically, one end portion (the right end portion in FIG. 4) of the bottom of the rocker arm body 1' is formed into a semi-spherical portion, namely, a pivot engaging portion 6' which is abutted against the top of the pivot P, whereas the other end portion (the left end portion in FIG. 4) is formed into a valve engaging portion 7' which is abutted against the top of the valve stem V.

On the other hand, there is a general demand for reduction of the width of the rocker arm in the art. This requirement cannot be satisfied by the conventional rocker arm formed by pressing, because, although its width on the valve side can be reduced, it is difficult to reduce its width on the pivot side.

As was describe above, in the conventional rocker arm formed by pressing (hereinafter referred to as "a conventional rocker arm", when applicable), one end portion of the bottom of the rocker arm body 1' U-shaped in section is formed into the pivot engaging portion 6'. In order to provide the pivot engaging portion 6' with high accuracy, it is essential that the periphery of the pivot engaging portion 6' is flat. Hence, there must be a certain distance D between the pivot engaging portion 6' and each of the side walls 6'; otherwise the side walls adversely affects the configuration of the pivot engaging portion 6'.

The diameter of the pivot P of the lash adjuster has been predetermined, and accordingly the diameter of the pivot engaging portion 6' also has been predetermined, which causes the distance between the end portions of the side walls which are located beside the pivot engaging portion 6' (hereinafter referred to as "pivot-side portions", when applicable) to be larger than a certain value. That is, in each of the side walls 3', its middle portion 31' is shifted from its pivot-side portion 32' as shown in FIG. 5.

This fact adversely affects the manufacture of the conventional rocker arm. That is, in the conventional rocker arm, the roller supporting pin 5' is inserted into the side walls 31' of the rocker arm body 1', which is V-shaped in section and secured to it by caulking. However, it may be rather difficult to positively secure the pin 5' to the side walls by caulking, because the fixing of the rocker arm body 1' during the caulking process may be loosened or unstable due to the above-described structure that the middle portions 31' of the side walls are shifted from the pivot-side portions 32' of the latter.

SUMMARY OF THE INVENTION

Accordingly, an object of the invention is to eliminate the above-described difficulties accompanying a conventional rocker arm formed by pressing.

More specifically, an object of the invention is to provide a rocker arm formed by pressing in which the rocker arm body is reduced in width, and the roller supporting pin is positively secured to the side walls by caulking, without lowering the dimensional accuracy of the pivot engaging portion.

The foregoing object and other objects of the invention have been achieved by the provision of a rocker arm formed by pressing which comprises:

a rocker arm body including a pair of side walls, which is substantially U-shaped in section and is made of a plate material; and a roller rotatably supported between the side walls of the rocker arms substantially at the middle as viewed longitudinally of the rocker arm body, the rocker arm body having a semi-spherical pivot engaging portion at one end, and a valve engaging portion at the other end, in which, according to the invention, each of the side walls has a portion beside the pivot engaging portion which is smaller in wall thickness than the remaining portion.

In the rocker arm, the pivot-side portions of the side walls which are located on both sides of the pivot engaging portion are reduced in wall thickness, and accordingly the distance between the outer surfaces of the pivot-side portions of the side walls can be reduced, while maintaining a predetermined space between the pivot engaging portion and each of pivot side portions of the side walls. In addition, by reducing the wall thickness in the outer surface of the above described manner, the distance between the middle portions of the side walls are made equal to that between the outer surface of the pivot-side portions of the side walls; that is, no steps are formed between the outer surface of the middle portions and the outer surface of the pivot-side portions of the side walls. Thus, the rocker arm body is improved in dimensional accuracy as a whole, and it can be stably fixed when the pin is to be secured to it by caulking; that is, the pin can be positively secured to the rocker arm body.

The nature, utility and principle of the invention will be more clearly understood from the following detailed description and the appended claim when read in conjunction with the accompanying drawing in which like parts are designated by like reference numerals or characters.

DETAILED DESCRIPTION OF THE PREFERRED EMBODIMENTS

Figure 1:
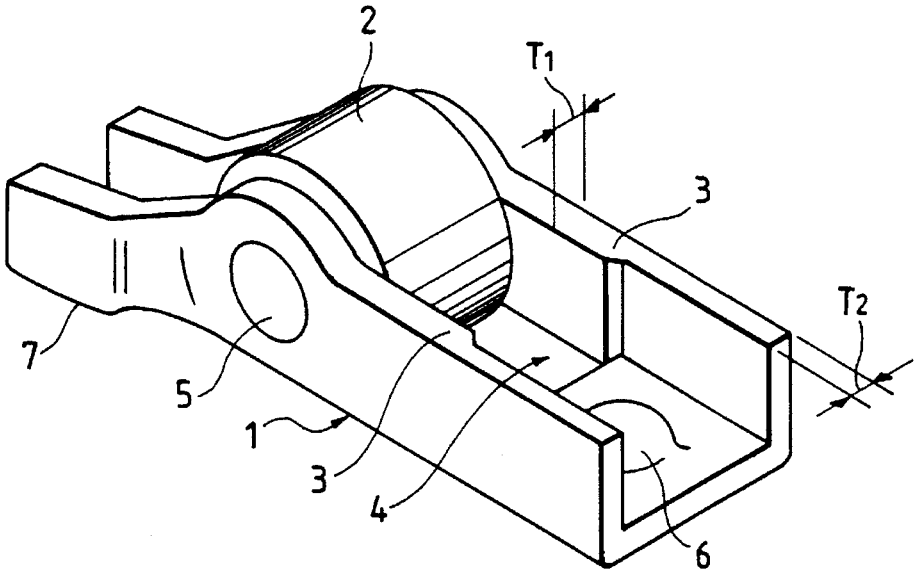
FIGS. 1 and 2 are a perspective view and a plan view, respectively, showing an example of a rocker arm, which constitutes a first embodiment of the invention.
Figure 2:
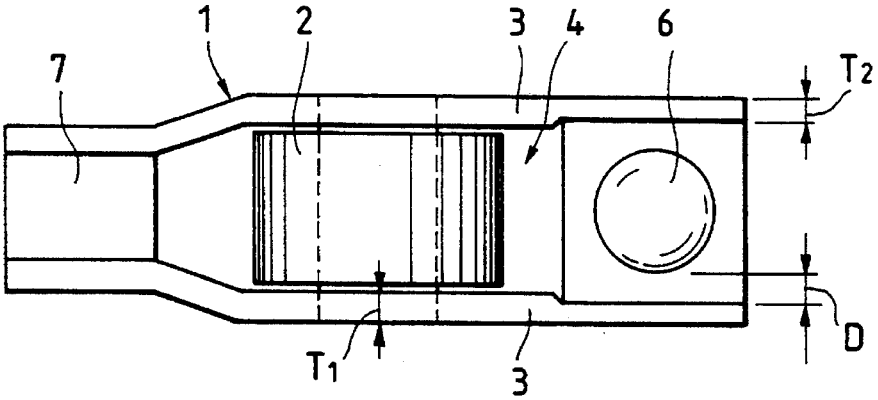
Figure 3:
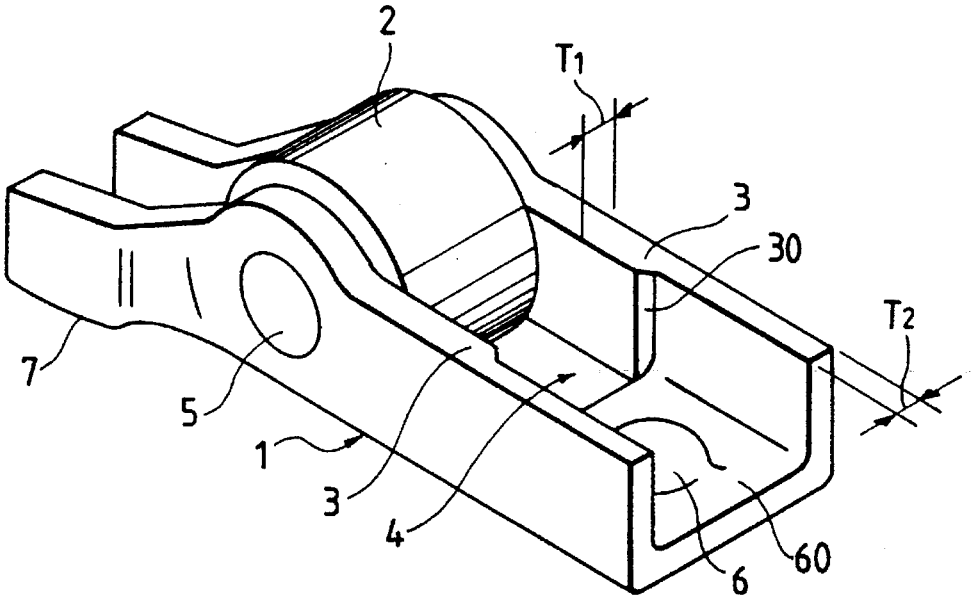
FIG. 3 is a perspective view showing another example of the rocker arm, which constitutes a second embodiment of the invention.

Preferred embodiments of the invention will be described with reference to FIGS. 1 through 3.

First embodiment

An example of a rocker arm formed by pressing, which constitutes a first embodiment of the invention, will be described with reference to FIGS. 1 and 2.

Figure 5:
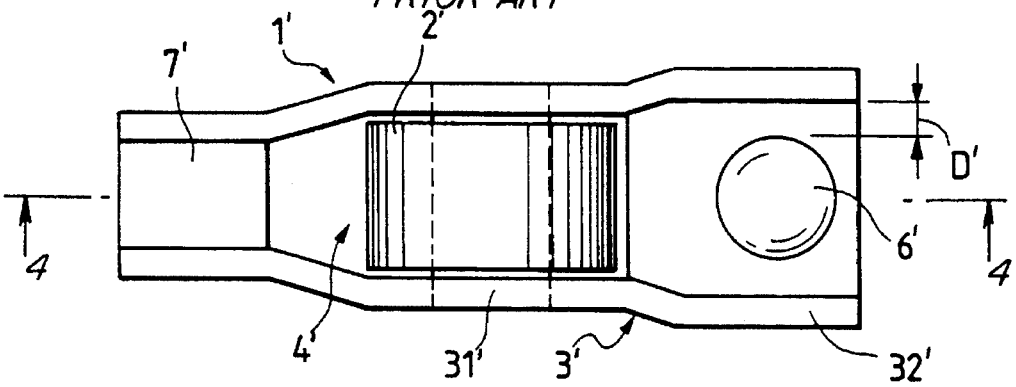
FIG. 5 PRIOR ART
FIGS. 4 and 5 are a longitudinal sectional view and a plan view of a conventional rocker arm.
Figure 4:
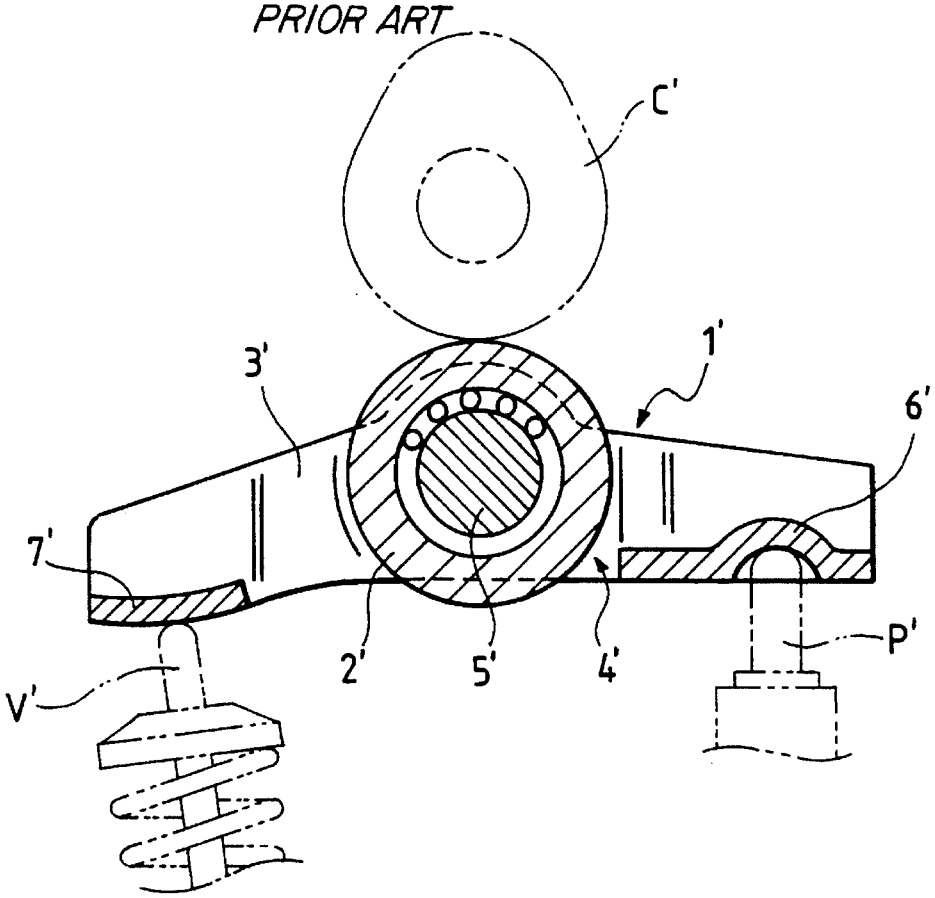
FIG. 4 PRIOR ART

Similarly as in the case of the above-described conventional rocker arm, the rocker are according to the invention comprises: a rocker arm body I which, being formed by pressing a steel plate (made, for instance, of chrome-molybdenum steel (SCM) material regulated by JIS), is U-shaped in section having side walls 3 and 3 on its both sides, and a bottom between those side walls, which bottom has a rectangular through-hole 4 substantially at the middle as viewed longitudinally thereof; and a roller 2 which is located in the through-hole 4, and rotatably supported on the side walls 3 and 3 through a pin 5. More specifically, one end portion of the bottom of the rocker arm body 1 is formed into a flat coupling portion where a semi-spherical portion, namely, a pivot engaging portion 6 is formed, whereas the other end portion is formed into a valve engaging portion 7. Therefore, in FIGS. 1 and 2, parts corresponding functionally to those which have been described with reference to FIGS. 4 and 5 (the prior art) are therefore designated by the same reference numerals without the prime.

A specific feature of the rocker arm of the invention resides in the structure of the portion of the rocker arm body which is located beside the pivot engaging portion 6. That is, the wall thickness of each of the end portions (the right end portions in FIGS. 1 and 2) of the side walls 3 which portions are located on both sides of the pivot engaging portion 6 (hereinafter referred to as "pivot-side portions", when applicable) is reduced to a value $T_2$ smaller than the wall thickness $T_1$ of the remaining ($T_1>T_2$). In other words, in order to make the wall thickness of the pivot-side portions of the side walls 3 and 3 smaller than that of the remaining, the inner surfaces of the pivot-side portions are recessed. The reduction of the wall thickness of the pivot-side portions of the side walls 3 may be carried out by rolling, forging or machining the plate material before it is pressed, or after it is made U-shaped. As shown in FIG. 2, in the flat coupling portion where the pivot engaging portion 6 is formed, a distance D is provided between the pivot engaging portion 6 and each of the pivot-side portions of the side walls which have been recessed in the above-described manner; that is, the pivot engaging portion 6 is spaced as much as the distance D from each of the pivot-side portions thus recessed.

As is apparent from the above description, the outward inflation (or bend) of the side walls 3 and 3 is reduced as much as the pivot-side portions of the side walls 3 are decreased in wall thickness in the above-described manner. Hence, the flat coupling portion around the pivot engaging portion 6 is large enough, and yet the distance between the side walls 3 and 3 is maintained unchanged; that is, the distance between the pivot-side portions of the side walls is equal to the distance between the middle portions of the side walls which are located on both sides of the roller 2.

As was described before, the rocker arm body 1 substantially U-shaped in section has the bottom between the side walls 3 and 3 which includes the valve engaging portion 7 and the flat coupling portion where the pivot engaging portion 6 is formed. In other words, the spot-side portions of the side walls which are reduced in wall thickness are extended upwardly from both edges of the flat coupling portion where the pivot engaging portion is formed. Hence, the rocker arm of the invention is less sprung back than the conventional one in which the side walls are extended upwardly from both edges of the flat coupling portion with side walls 3' of the conventional rocker arm having pivot-side portions 32' that are not reduced in wall thickness from the wall thickness of middle portions 31'. In addition, the accurate distance between the outer surface of side walls 3 and 3 can be maintained. Furthermore, the roller supporting pin inserted into the side walls 3 can be positively secured thereto by caulking.

Second Embodiment

In the above-described first embodiment, the rocker arm body including the pivot engaging portion 6 and the valve engaging portion 7 is of a so-called "one-piece structure"; however, the invention is not limited thereto or thereby. That is, the technical concept of the invention may be applied to a rocker arm body of a so-called "two-piece structure as shown in FIG. 3, in which the flat coupling portion 60 between the side walls 3 and 3 is prepared separately from the rocker arm body 1, and it is connected to the rocker arm body 1, for instance, by welding. In this case, when the rocker arm body 1 is formed by blanking, or before bent or drawn, the pivot-side portions of the side walls 3 and 3, which are connected to the flat coupling portion 60, are reduced in wall thickness by forging or rolling. This wall thickness reducing operation can be achieved readily because the rocker arm body 1, unlike the one in the first embodiment, is provided separately from the flat coupling portion 60 including the pivot engaging portion. As shown in FIG. 3, steps 30 are formed in the side walls when the latter are reduced in wall thickness in the above-described manner. The steps 30 thus formed permit the flat coupling portion 60 to be positioned accurately and connected to the rocker arm body 1 with ease.

Effects of the Invention

As is apparent from the above description, the rocker arm of the invention has the following effects or merits: With the sufficiently large spaces on both sides of the pivot engaging portion the outward inflation (or bend) of the side walls is suppressed; that is, the rocker arm is smaller in width as a whole than the conventional one. Furthermore, the pivot engaging portion can be formed with high accuracy, and therefore it can be smoothly engaged with the pivot of the lash adjuster.

In addition, the rocker arm body U-shaped in section can be readily fixed. Hence, the work of securing the pin to the side walls by caulking is stable; that is, the pin can be positively secured to the side walls.

While there has been described in connection with the preferred embodiments of this invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A rocker arm comprising:

a rocker arm body including a pair of side walls, said rocker arm body being substantially U-shaped in section;

a roller rotatably supported between middle portions of said side walls of said rocker arm body;

said rocker arm body having a semi-spherical pivot engaging portion at a first end, and a valve engaging portion at a second end opposite from said first end with respect to said roller, each of said side walls having a pivot-side portion which is located at said first end and is smaller in wall thickness than said middle portions of said side walls.

2. A rocker arm according to claim 1, wherein said pivot-side portions are spaced from said semi-spherical pivot engaging portion by flat coupling portions of predetermined length.

3. A rocker arm according to claim 1, wherein said semi-spherical pivot engaging portion is formed on a flat coupling portion integral with said pivot-side portions, such that said flat coupling portion includes flat sections of predetermined length extending laterally between said semi-spherical pivot engaging portion and said pivot-side portions.

4. A rocker arm according to claim 1, wherein said semi-spherical pivot engaging portion is formed on a flat coupling portion welded to said pivot-side portions, such that said flat coupling portion includes flat sections of predetermined length extending laterally between said semi-spherical pivot engaging portion and said pivot-side portions.

* * * * *